US009732309B2

(12) United States Patent
Garcia Marcos et al.

(10) Patent No.: US 9,732,309 B2
(45) Date of Patent: Aug. 15, 2017

(54) FORMULATIONS, THEIR USE AS OR FOR PRODUCING DISHWASHING DETERGENTS AND THEIR PRODUCTION

(71) Applicant: BASF SE, Ludwigshafen (DE)

(72) Inventors: Alejandra Garcia Marcos, Ludwigshafen (DE); Stephan Hueffer, Ludwigshafen (DE); Markus Hartmann, Neustadt (DE); Heike Weber, Mannheim (DE); Mario Emmeluth, Bensheim (DE)

(73) Assignee: BASF SE, Ludwigshafen (DE)

( * ) Notice: Subject to any disclaimer, the term of this patent is extended or adjusted under 35 U.S.C. 154(b) by 1124 days.

(21) Appl. No.: 13/870,206

(22) Filed: Apr. 25, 2013

(65) Prior Publication Data

US 2013/0284211 A1 Oct. 31, 2013

Related U.S. Application Data

(60) Provisional application No. 61/637,891, filed on Apr. 25, 2012, provisional application No. 61/637,901, filed on Apr. 25, 2012, provisional application No. 61/637,911, filed on Apr. 25, 2012, provisional application No. 61/697,817, filed on Sep. 7, 2012.

(30) Foreign Application Priority Data

| | | |
|---|---|---|
| Apr. 25, 2012 | (EP) | 12165545 |
| Apr. 25, 2012 | (EP) | 12165550 |
| May 15, 2012 | (EP) | 12168038 |
| May 15, 2012 | (EP) | 12168044 |
| May 15, 2012 | (EP) | 12168054 |
| Sep. 7, 2012 | (EP) | 12183437 |

(51) Int. Cl.

| | |
|---|---|
| ***C11D 3/37*** | (2006.01) |
| ***C11D 3/33*** | (2006.01) |
| ***C11D 11/00*** | (2006.01) |
| ***C11D 11/02*** | (2006.01) |

(52) U.S. Cl.

CPC ..... *C11D 3/3723* (2013.01); *C11D 3/33* (2013.01); *C11D 11/0082* (2013.01); *C11D 11/02* (2013.01)

(58) Field of Classification Search

CPC ..... C11D 3/3723; C11D 3/33; C11D 3/37; C11D 11/02

See application file for complete search history.

(56) References Cited

U.S. PATENT DOCUMENTS

| | | | | |
|---|---|---|---|---|
| 5,904,735 | A | 5/1999 | Gutierrez et al. | |
| 6,815,410 | B2 * | 11/2004 | Boutique | C11D 3/2086 510/295 |
| 7,736,525 | B2 | 6/2010 | Thankachan et al. | |
| 8,535,450 | B2 * | 9/2013 | Hueffer | C11D 3/0073 134/25.2 |
| 8,574,374 | B2 * | 11/2013 | Hueffer | C11D 3/0073 134/25.2 |
| 8,709,990 | B2 * | 4/2014 | Hueffer | C11D 3/2086 510/220 |
| 8,841,245 | B2 | 9/2014 | Scialla et al. | |
| 8,846,593 | B2 * | 9/2014 | Hueffer | C11D 3/3723 510/220 |
| 2003/0195135 | A1 * | 10/2003 | Boeckh | C11D 3/046 510/475 |
| 2003/0199414 | A1 * | 10/2003 | Boutique | C11D 3/2086 510/293 |
| 2005/0176599 | A1 | 8/2005 | Bergquist et al. | |
| 2009/0011970 | A1 * | 1/2009 | Evers | C11D 17/045 510/277 |
| 2009/0011971 | A1 * | 1/2009 | Evers | C11D 3/3942 510/296 |
| 2009/0215662 | A1 | 8/2009 | Boeckh et al. | |
| 2011/0183883 | A1 | 7/2011 | Hahn et al. | |
| 2011/0190190 | A1 | 8/2011 | Schubert et al. | |
| 2011/0195481 | A1 | 8/2011 | Svendsen et al. | |
| 2011/0294977 | A1 | 12/2011 | Schaub et al. | |

FOREIGN PATENT DOCUMENTS

| | | | |
|---|---|---|---|
| CA | 2296719 | A1 | 2/1999 |
| DE | 198 19 187 | A1 | 11/1999 |
| EP | 0 851 023 | A2 | 7/1998 |
| EP | 2662436 | A1 | 11/2013 |
| WO | 99/07815 | A1 | 2/1999 |
| WO | WO 99/05248 | | 2/1999 |
| WO | WO 01/96516 | A1 | 12/2001 |
| WO | WO 2006/108857 | A1 | 10/2006 |
| WO | WO 2009/092699 | A1 | 7/2009 |
| WO | WO 2010/020765 | A1 | 2/2010 |

OTHER PUBLICATIONS

International Search Report issued Sep. 13, 2013, in International Patent Application No. PCT/EP2013/058391 (with English Translation of Category of Cited Documents).
U.S. Appl. No. 13/869,111, filed Apr. 24, 2013, Hueffer, et al.
U.S. Appl. No. 13/866,350, filed Apr. 19, 2013, Hueffer, et al.
U.S. Appl. No. 14/771,100, filed Aug. 27, 2015, Hueffer et al.
Non Final Office Action for U.S. Appl. No. 14/786,327, dated May 3, 2016 (14 pp.).

* cited by examiner

*Primary Examiner* — Gregory Webb
(74) *Attorney, Agent, or Firm* — Oblon, McClelland, Maier & Neustadt, L.L.P.

(57) ABSTRACT

Formulations comprising (A) at least one aminocarboxylate selected from methylglycine diacetate (MGDA), iminodisuccinic acid (IDA) and glutamic acid diacetate (GLDA), and salts and derivatives thereof, and (B) at least one alkoxylated alkyleneimine polymer with an average molecular weight $M_w$ in the range from 800 to 25 000 g/mol which has a positive charge density of at least 5 meq/g and which has in the range from 2 to at most 80% by weight alkylene oxide side chains, based on total alkoxylated alkyleneimine polymer.

20 Claims, No Drawings

FORMULATIONS, THEIR USE AS OR FOR PRODUCING DISHWASHING DETERGENTS AND THEIR PRODUCTION

CROSS REFERENCE TO RELATED APPLICATIONS

The present application claims priority to U.S. Provisional application Ser. No. 61/637,891 filed Apr. 25, 2012; 61/637,901 filed Apr. 25, 2012; 61/637,911, filed Apr. 25, 2012; and 61/697,817 filed Sep. 7, 2012, the entire contents of each of which are hereby incorporated by reference.

Additionally, the present application claims priority to EP application serial nos. 12165545.0 filed Apr. 25, 2012; 12165550.0 filed Apr. 25, 2012; 12168038.3 filed May 15, 2012; 12168044.1 filed May 15, 2012; 12168054.0 filed May 15, 2012; and 12183437.8 filed Sep. 7, 2012, the entire contents of each of which are hereby incorporated by reference.

The present invention relates to formulations comprising (A) at least one aminocarboxylate selected from methylglycine diacetate (MGDA), iminodisuccinic acid (IDA) and glutamic acid diacetate (GLDA), and salts thereof, and (B) at least one alkoxylated alkyleneimine polymer with an average molecular weight $M_w$ in the range from 800 to 25 000 g/mol which has a positive charge density of at least 5 meq/g and which has in the range from 2 to at most 80% by weight alkylene oxide side chains, based on total alkoxylated alkyleneimine polymer.

Furthermore, the present invention relates to a process for producing formulations according to the invention and to their use as or for producing dishwashing detergents, in particular dishwashing detergents for machine dishwashing.

Dishwashing detergents have to meet many requirements. For example, they have to clean the dishes thoroughly, they should have no harmful or potentially harmful substances in the waste water, they should permit the running-off and drying of the water from the dishes, and they should not lead to problems during the operation of the dishwasher. Finally, they should not lead to esthetically undesirable results on the item to be cleaned. In this connection, glass corrosion is to be mentioned in particular.

Glass corrosion arises not only as a result of mechanical effects, for example as a result of glasses rubbing together or mechanical contact between the glasses and parts of the dishwasher, but is primarily promoted by chemical influences. For example, certain ions can be dissolved out of the glass as a result of repeated machine cleaning, which adversely alters the optical and thus esthetic properties.

Several effects are observed with glass corrosion. Firstly, the formation of microscopically fine cracks can be observed which become noticeable in the form of lines. Secondly, in many cases, general hazing can be observed, for example a roughening which makes the glass in question appear unattractive. Effects of this type are overall also subdivided into iridescent discoloration, scoring, as well as patchy and circular clouding.

WO 2006/108857 discloses alkoxylated polyethyleneimines as additives to detergents. By way of example, detergents are disclosed which comprise zeolites or polyaminocarboxylates such as EDTA or triethylenediamine pentaacetate as complexing agents.

WO 01/96516 proposes formulations which comprise alkoxylated polyethyleneimine for cleaning hard surfaces. Purified water is used for rinsing.

WO 2010/020765 discloses dishwashing detergents which comprise polyethyleneimine. Dishwashing detergents of this type can comprise phosphate or be phosphate-free. They are attributed good inhibition of glass corrosion. Zinc-containing and bismuth-containing dishwashing detergents are discouraged. Glass corrosion, in particular line corrosion and clouding, however, is in many cases still not adequately delayed or prevented.

It was therefore the object to provide formulations which are suitable as or for producing dishwashing detergents and which avoid the disadvantages known from the prior art and which inhibit glass corrosion or at least reduce it particularly well. It was also the object to provide a process for producing formulations which are suitable as or for producing dishwashing detergents and which avoid the disadvantages known from the prior art. It was also the object to provide uses of formulations.

Accordingly, the formulations defined at the outset have been found, also called for short formulations according to the invention.

Formulations according to the invention are heavy metal-free. Within the context of the present invention, this is to be understood as meaning that formulations according to the invention are free from those heavy metal compounds which do not act as bleach catalysts, in particular compounds of iron and of bismuth. In connection with heavy metal compounds, within the context of the present invention, "free from" is to be understood as meaning that the content of heavy metal compounds which do not act as bleach catalysts is in total in the range from 0 to 100 ppm, determined by the Leach method and based on the solids content. Preferably, formulation according to the invention has a heavy metal content below 0.05 ppm, based on the solids contents of the formulation in question.

Within the context of the present invention, "heavy metals" are all metals having a specific density of at least 6 g/cm$^3$. In particular, heavy metals are precious metals and also zinc, bismuth, iron, copper, lead, tin, nickel, cadmium and chromium.

Preferably, formulation according to the invention comprises no measurable fractions of zinc and bismuth compounds, i.e. for example less than 1 ppm.

Formulations according to the invention comprise (A) at least one aminocarboxylate selected from methylglycine diacetate (MGDA), iminodisuccinic acid (IDA) and glutamic acid diacetate (GLDA), and salts thereof, within the context of the present invention also called for short aminocarboxylate (A) or else compound (A), and preferably salts thereof.

Preferably, compound (A) is selected as free acid, particularly preferably in partially or completely neutralized form, i.e. as salt. Suitable counterions are for example inorganic cations, for example ammonium, alkali metal or alkaline earth metal, preferably $Mg^{2+}$, $Ca^{2+}$, $Na^+$, $K^+$, or organic cations, preferably ammonium substituted with one or more organic radicals, in particular triethanolammonium, N,N-diethanolammonium, N-mono-$C_1$-$C_4$-alkyldiethanolammonium, for example N-methyldiethanolammonium or N-n-butyldiethanolammonium, and N,N-di-$C_1$-$C_4$-alkylethanolammonium.

Very particularly preferred compounds (A) are the alkalimetal salts, in particular the sodium salts of methylglycine diacetate (MGDA), iminodisuccinic acid (IDA) and glutamic acid diacetate (GLDA).

Very particularly preferably, methylglycine diacetate (MGDA), iminodisuccinic acid (IDA) or glutamic acid diacetate (GLDA) is completely neutralized.

Furthermore, formulations according to the invention comprise (B) at least one alkoxylated alkyleneimine polymer with an average molecular weight $M_w$ in the range from 800 to 25 000 g/mol which has a positive charge density of at least 5 meq/g and which has in the range from 2 to at most 80% by weight, preferably 5 to 60% by weight, alkylene oxide side chains, based on total alkoxylated alkyleneimine polymer.

Within the context of the present invention, modified alkyleneimine polymers of this type are also called modified polyalkyleneimine (B) for short.

Within the context of the present invention, alkyleneimine polymers are to be understood as meaning those polymeric materials which are obtained by homo- or copolymerization of one or more cyclic imines, or by grafting a (co)polymer with at least one cyclic imine. Examples are polyalkylenepolyamines and polyamidoamines grafted with ethyleneimine.

Within the context of the present invention, polyalkylenepolyamines are preferably to be understood as meaning those polymers which comprise at least six nitrogen atoms and at least five $C_2$-$C_{10}$-alkylene units, preferably $C_2$-$C_3$-alkylene units, per molecule, for example pentaethylenehexamine, and in particular polyethyleneimines.

Alkyleneimine polymer and in particular polyethyleneimine can, for example, have an average molecular weight ($M_w$) of at least 300 g/mol; preferably, the average molecular weight of polyethyleneimine is in the range from 800 to 20 000 g/mol, ascertained by light scattering.

Polyalkylenepolyamines can be covalently modified in partially quaternized (alkylated) form as alkyleneimine polymers. Suitable quaternizing agents (alkylating agents) are, for example, alkyl halides, in particular $C_1$-$C_{10}$-alkyl chloride such as methyl chloride, methyl bromide, methyl iodide, ethyl chloride, ethyl bromide, n-butyl chloride, tert-butyl chloride, n-hexyl chloride, also epichlorohydrin, dimethyl sulfate, diethyl sulfate and benzyl chloride. If quaternized (alkylated) polyalkylenepolyamines as alkyleneimine polymers are covalently modified, the degree of quaternization (alkylation) is preferably 1 to 25, particularly preferably up to 20 mol %, based on quaternizable (alkylatable) N atoms in alkyleneimine polymer.

Furthermore, polyamidoamines grafted with ethyleneimine are suitable as alkyleneimine polymers. Suitable polyamidoamines are obtainable for example by reacting $C_4$-$C_{10}$-dicarboxylic acids with polyalkylenepolyamines which preferably comprise 3 to 10 basic nitrogen atoms in the molecule. Suitable dicarboxylic acids are, for example, succinic acid, maleic acid, adipic acid, glutaric acid, suberic acid, sebacic acid or terephthalic acid. It is also possible to use mixtures of the aforementioned dicarboxylic acids, for example mixtures of adipic acid and glutaric acid or mixtures of maleic acid and adipic acid. Preference is given to using adipic acid for producing polyamidoamines. Suitable polyalkylenepolyamines which are condensed with the aforementioned dicarboxylic acids are, for example, diethylenetriamine, triethylenetetramine, dipropylenetriamine, tripropylenetetramine, dihexamethylenetriamine, aminopropylethylenediamine and bis-aminopropylethylenediamine. Aforementioned polyalkylenepolyamines can also be used in the form of mixtures in the production of polyamidoamine. The production of polyamidoamine preferably takes place without dilution, but can optionally also be carried out in inert solvents. The condensation of dicarboxylic acid with polyalkylenepolyamine takes place at elevated temperatures, for example in the range from 120 to 220° C. The water formed during the reaction is distilled off from the reaction mixture. The condensation can optionally be carried out in the presence of lactones or lactams of carboxylic acids having 4 to 8 carbon atoms. In general, 0.8 to 1.4 mol of a polyalkylenepolyamine are used per mole of dicarboxylic acid. Polyamidoamines obtainable in this way have primary and second NH groups and are soluble in water.

Polyamidoamines grafted with ethyleneimine can be prepared by allowing ethyleneimine to act on the polyamidoamine described above in the presence of Brönstedt acids or Lewis acids, for example sulfuric acid, phosphoric acid or boron trifluoride etherate. As a result, ethyleneimine is grafted onto the polyamidoamine in question. For example, 1 to 10 ethyleneimine units can be grafted on per basic nitrogen atom in the polyamidoamine, i.e. about 10 to 500 parts by weight of ethyleneimine are used per 100 parts by weight of polyamidoamine.

A preferred alkyleneimine polymer is polyethyleneimine.

In one embodiment of the present invention, polyethyleneimines are selected from highly branched polyethyleneimines. Highly branched polyethyleneimines are characterized by their high degree of branching (DB). The degree of branching can be determined for example by $^{13}$C-NMR spectroscopy, preferably in $D_2O$, and is defined as follows:

$$DB=D+T/D+T+L$$

with D (dendritic) corresponding to the fraction of tertiary amino groups, L (linear) corresponding to the fraction of secondary amino groups and T (terminal) corresponding to the fraction of primary amino groups.

Within the context of the present invention, highly branched polyethyleneimines are polyethyleneimines with DB in the range from 0.1 to 0.95, preferably 0.25 to 0.90, particularly preferably in the range from 0.30 to 0.80 and very particularly preferably at least 0.5.

In one embodiment of the present invention, polyethyleneimine is highly branched polyethyleneimines (homopolymers) with an average molecular weight $M_w$ in the range from 600 to 20 000 g/mol, preferably in the range from 800 to 15 000 g/mol.

Within the context of the present invention, alkyleneimine polymer is used in covalently modified form, and specifically such that it has in the range from 2 to 80% by weight, preferably 5 to 60% by weight, alkylene oxide side chains, based on total alkoxylated alkyleneimine polymer (B). For the alkoxylation, epoxides can be used, for example ethylene oxide, propylene oxide, 1,2-butylene oxide, 2,3-butylene oxide, styrene oxide or epichlorohydrin. Preferred alkoxylation reagents are ethylene oxide and propylene oxide, and also mixtures of ethylene oxide and propylene oxide.

In one embodiment, in alkoxylated alkyleneimine polymer (B), in the range from 5 to 60 mol % of the nitrogen atoms of the primary and secondary amino groups of the alkyleneimine polymer are alkoxylated.

In one embodiment of the present invention, modified alkyleneimine (B) is selected from polyethyleneimines which have been reacted with ethylene oxide or propylene oxide.

Modified polyalkyleneimine (B) can have, as counterions, high molecular weight or low molecular weight anions, organic or preferably inorganic. Within the context of the present invention, high molecular weight anions have an average molecular weight of 200 g/mol or more, for example up to 2500 g/mol, low molecular weight anions have a molecular weight of less than 200 g/mol, for example from 17 to 150 g/mol. Examples of low molecular weight organic counterions are acetate, propionate and benzoate. Examples of low molecular weight inorganic counterions are sulfate, chloride, bromide, hydroxide, carbonate, methanesulfonate and hydrogencarbonate.

In one embodiment of the present invention, modified polyalkyleneimine (B) has a cationic charge density of at least 5 meq/g up to at most 25 meq/g (milliequivalents/g), preferably up to 22 meq/g, the data in g referring to modified polyalkyleneimine (B) without taking into consideration the counterions. The cationic charge density can be ascertained for example by titration, for example with polyvinyl sulfate solution.

In one embodiment of the present invention, modified polyalkyleneimine (B) has a molecular weight distribution $M_w/M_n$ in the range from 1.1 to 10, preferably 1.5 to 5.

In one embodiment of the present invention, formulations according to the invention comprise in total in the range from 1 to 50% by weight of aminocarboxylate (A), preferably 10 to 25% by weight, in total in the range from 0.001 to 5% by weight of modified polyalkyleneimine (B), preferably 0.02 to 0.5% by weight, based in each case on solids content of the formulation in question.

In one variant of the present invention, formulation according to the invention comprises compound (A) and modified polyalkyleneimine (B) in a weight ratio in the range from 1000:1 to 25:1.

In a preferred embodiment of the present invention, formulation according to the invention is free from phosphates and polyphosphates, with hydrogen phosphates also being subsumed, for example free from trisodium phosphate, pentasodium tripolyphosphate and hexasodium metaphosphate. In connection with phosphates and polyphosphates, within the context of the present invention, "free from" is to be understood as meaning that the content of phosphate and polyphosphate is in total in the range from 10 ppm to 0.2% by weight, determined by gravimetry.

Formulations according to the invention can comprise further components which are advantageous for example for use when washing dishes and/or kitchen utensils.

In another embodiment of the present invention, formulations according to the invention comprise no further components which are advantageous for example for use when washing dishes and/or kitchen utensils, but can be readily formulated with further components and are therefore suitable as starting material.

In one embodiment of the present invention, formulations according to the invention comprise sodium citrate (C). In this connection, the term sodium citrate includes the monosodium salt and preferably the disodium salt. Sodium citrate can be used as anhydrous salt or as hydrate, for example as dihydrate.

In one embodiment of the present invention, formulations according to the invention comprise (D) at least one compound selected from alkali metal percarbonate, alkalimetal perborate and alkalimetal persulfate, within the context of the present invention also called "bleach (D)".

Preferred bleaches (D) are selected from sodium perborate, anhydrous or, for example, as monohydrate or as tetrahydrate or so-called dihydrate, sodium percarbonate, anhydrous or, for example, as monohydrate, and sodium persulfate, the term "persulfate" in each case including the salt of the peracid $H_2SO_5$ and also the peroxodisulfate.

In this connection, the alkali metal salts can in each case also be alkali metal hydrogencarbonate, alkali metal hydrogen perborate and alkali metal hydrogen persulfate. However, preference is given in each case to the dialkalimetal salts.

In one embodiment of the present invention, formulation according to the invention comprises zero to 50% by weight of sodium citrate (C), preferably 1 to 30% by weight, particularly preferably at least 5% by weight of sodium citrate (C), determined as anhydrous sodium citrate, in total zero to 15% by weight of bleach (D), preferably at least 0.5% by weight of bleach (D), selected from alkalimetal percarbonate, alkalimetal perborate and alkalimetal persulfate, based in each case on solids content of the formulation in question.

In one embodiment of the present invention, formulation according to the invention is solid at room temperature, for example a powder or a tablet. In another embodiment of the present invention, formulation according to the invention is liquid at room temperature. In one embodiment of the present invention, formulation according to the invention is granules, a liquid preparation or a gel.

In one embodiment of the present invention, formulation according to the invention comprises 0.1 to 10% by weight of water, based on the sum of all solids of the formulation in question.

In one embodiment of the present invention, the formulation according to the invention can have further ingredients (E), for example one or more surfactants, one or more enzymes, one or more builders, in particular phosphorus-free builders, one or more cobuilders, one or more alkali carriers, one or more bleaches, one or more bleach catalysts, one or more bleach activators, one or more bleach stabilizers, one or more antifoams, one or more corrosion inhibitors, one or more builder substances, buffers, dyes, one or more fragrances, one or more organic solvents, one or more tableting auxiliaries, one or more disintegrants, one or more thickeners, or one or more solubility promoters.

Examples of surfactants are in particular nonionic surfactants and also mixtures of anionic or zwitterionic surfactants with nonionic surfactants. Preferred nonionic surfactants are alkoxylated alcohols and alkoxylated fatty alcohols, di- and multiblock copolymers of ethylene oxide and propylene oxide and reaction products of sorbitan with ethylene oxide or propylene oxide, alkyl glycosides and so-called amine oxides.

Preferred examples of alkoxylated alcohols and alkoxylated fatty alcohols are, for example, compounds of the general formula (I)

(I)

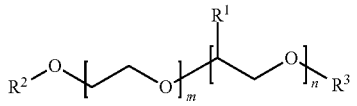

in which the variables are defined as follows:

$R^1$ is identical or different and selected from linear $C_1$-$C_{10}$-alkyl, preferably in each case identical and ethyl and particularly preferably methyl, $R^2$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one. Preferably, m is in the range from 1 to 100 and n is in the range from 0 to 30.

Here, compounds of the general formula (I) may be block copolymers or random copolymers, preference being given to block copolymers.

Other preferred examples of alkoxylated alcohols and alkoxylated fatty alcohols are, for example, compounds of the general formula (II)

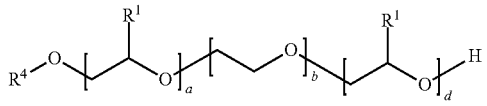

(II)

in which the variables are defined as follows:

$R^1$ is identical or different and selected from linear $C_1$-$C_0$-alkyl, preferably identical in each case and ethyl and particularly preferably methyl, $R^4$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$, a is a number in the range from 1 to 6, b is a number in the range from 4 to 20, d is a number in the range from 4 to 25.

Here, compounds of the general formula (II) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl glycosides are likewise suitable. An overview of suitable further nonionic surfactants can be found in EP-A 0 851 023 and in DE-A 198 19 187.

Mixtures of two or more different nonionic surfactants may also be present.

Examples of anionic surfactants are $C_8$-$C_{20}$-alkyl sulfates, $C_8$-$C_{20}$-alkylsulfonates and $C_8$-$C_{20}$-alkyl ether sulfates with one to 6 ethylene oxide units per molecule.

In one embodiment of the present invention, the formulation according to the invention can comprise in the range from 3 to 20% by weight of surfactant.

Formulations according to the invention can comprise one or more enzymes. Examples of enzymes are lipases, hydrolases, amylases, proteases, cellulases, esterases, pectinases, lactases and peroxidases.

Formulations according to the invention can comprise, for example, up to 5% by weight of enzyme, preference being given to 0.1 to 3% by weight, in each case based on the total solids content of the formulation according to the invention.

Over and above sodium citrate (C), formulations according to the invention can comprise one or more builders, in particular phosphate-free builders. Examples of suitable builders are silicates, in particular sodium disilicate and sodium metasilicate, zeolites, sheet silicates, in particular those of the formula $\alpha$-$Na_2Si_2O_5$, $\beta$-$Na_2Si_2O_5$, and $\delta$-$Na_2Si_2O_5$, also fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

In one embodiment of the present invention, builders are selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40 000 g/mol, preferably 2000 to 10 000 g/mol, in particular 3000 to 8000 g/mol. Also of suitability are copolymeric polycarboxylates, in particular those of acrylic acid with methacrylic acid and of acrylic acid or methacrylic acid with maleic acid and/or fumaric acid.

It is also possible to use copolymers of at least one monomer from the group consisting of monoethylenically unsaturated $C_3$-$C_{10}$-mono- or $C_4$-$C_{10}$-dicarboxylic acids or anhydrides thereof, such as maleic acid, maleic anhydride, acrylic acid, methacrylic acid, fumaric acid, itaconic acid and citraconic acid, with at least one hydrophilically or hydrophobically modified monomer as listed below.

Suitable hydrophobic monomers are, for example, isobutene, diisobutene, butene, pentene, hexene and styrene, olefins with 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having on average 12 to 100 carbon atoms per molecule.

Suitable hydrophilic monomers are monomers with sulfonate or phosphonate groups, and also nonionic monomers with hydroxyl function or alkylene oxide groups. By way of example, mention may be made of: allyl alcohol, isoprenol, methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate and ethoxypoly (propylene oxide-co-ethylene oxide) (meth)acrylate. Polyalkylene glycols here can comprise 3 to 50, in particular 5 to 40 and especially 10 to 30 alkylene oxide units per molecule.

Particularly preferred sulfonic-acid-group-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as sodium, potassium or ammonium salts thereof.

Particularly preferred phosphonate-group-containing monomers are vinylphosphonic acid and its salts.

Moreover, amphoteric polymers can also be used as builders.

Formulations according to the invention can comprise, for example, in the range from in total 10 to 50% by weight, preferably up to 20% by weight, of builders.

In one embodiment of the present invention, formulations according to the invention can comprise one or more cobuilders.

Examples of cobuilders are phosphonates, for example hydroxyalkanephosphonates and aminoalkanephosphonates. Among the hydroxyalkanephosphonates, 1-hydroxyethane-1,1-diphosphonate (HEDP) is of particular importance as a cobuilder. It is preferably used as the sodium salt, the disodium salt giving a neutral reaction and the tetrasodium salt an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as hexasodium salt of EDTMP or as hepta- and octasodium salt of DTPMP.

Formulations according to the invention can comprise one or more alkali carriers. Alkali carriers ensure, for example, a pH of at least 9 if an alkaline pH is desired. Of suitability are, for example, alkali metal carbonates, alkali metal hydrogen carbonates, alkali metal hydroxides and alkali metal metasilicates. A preferred alkali metal is in each case potassium, particular preference being given to sodium.

Besides bleach (D), formulations according to the invention can comprise one or more chlorine-containing bleaches.

Suitable chlorine-containing bleaches are, for example, 1,3-dichloro-5,5-dimethylhydantoin, N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations according to the invention can comprise, for example, in the range from 3 to 10% by weight of chlorine-containing bleach.

Formulations according to the invention can comprise one or more bleach catalysts. Bleach catalysts can be selected from bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and also cobalt-, iron-, copper- and ruthenium-amine complexes can also be used as bleach catalysts.

Formulations according to the invention can comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxo-hexahydro-1,3,5-triazine ("DADHT") or nitrile quats (trimethylammonium acetonitrile salts).

Further examples of suitable bleach activators are tetraacetylethylenediamine (TAED) and tetraacetylhexylenediamine.

Formulations according to the invention can comprise one or more corrosion inhibitors. In the present case, this is to be understood as including those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, phloroglucinol or pyrogallol.

In one embodiment of the present invention, formulations according to the invention comprise in total in the range from 0.1 to 1.5% by weight of corrosion inhibitor.

Formulations according to the invention can comprise one or more builder substances, for example sodium sulfate.

Formulations according to the invention can comprise one or more antifoams, selected for example from silicone oils and paraffin oils.

In one embodiment of the present invention, formulations according to the invention comprise in total in the range from 0.05 to 0.5% by weight of antifoam.

Formulations according to the invention can comprise phosphonic acid or one or more phosphonic acid derivatives, for example hydroxyethane-1,1-diphosphonic acid.

The present invention further provides the use of formulations according to the invention for the machine cleaning of dishes and kitchen utensils. Within the scope of the present invention, kitchen utensils which may be mentioned are, for example, pots, pans, casseroles, also objects made of metal such as, for example, slotted spoons, fish slices and garlic presses.

Preference is given to the use of formulations according to the invention for the machine cleaning of objects which have at least one surface made of glass, which may be decorated or undecorated. In this connection, within the context of the present invention, a surface made of glass is to be understood as meaning that the object in question has at least one section made of glass which comes into contact with the ambient air and can become soiled upon use of the object. Thus, the objects in question may be those which, like drinking glasses or glass bowls, are essentially made of glass. However, they may, for example, also be lids which have individual components made of a different material, for example pot lids with rim and handle made of metal.

Surfaces made of glass can be decorated, for example colored or imprinted, or be undecorated.

The term "glass" includes any desired types of glass, for example lead glass and in particular soda-lime glass, crystal glass and borosilicate glasses.

Preferably, machine cleaning is washing with a dishwasher (automatic dishwashing).

In one embodiment of the present invention, at least one formulation according to the invention is used for the machine cleaning of drinking glasses, glass vases and glass vessels for cooking.

In one embodiment of the present invention, for the cleaning, water with a hardness in the range from 1 to 30° German hardness, preferably 2 to 25° German hardness is used, with German hardness being understood in particular as meaning the calcium hardness.

For the rinsing as well, it is also possible to use water with a hardness in the range from 1 to 30° German hardness, preferably 2 to 25° German hardness.

If formulations according to the invention are used for machine cleaning, then even in the case of repeated machine cleaning of objects which have at least one surface made of glass, only a very slight tendency towards glass corrosion is observed, and only then if objects which have at least one surface made of glass are cleaned together with heavily soiled cutlery or dishes. Furthermore, it is significantly less harmful to use the formulation according to the invention to clean glass together with objects made of metal, for example together with pots, pans or garlic presses.

Furthermore, it can be observed that formulations according to the invention have a very good bleaching effect when used for washing dishes and kitchen utensils and glass surfaces.

The present invention further provides a process for producing formulations according to the invention, for short also called production process according to the invention. To carry out the production process according to the invention, the procedure may, for example, be such that (A) aminocarboxylate selected from methylglycine diacetate (MGDA), iminodisuccinic acid (IDA) and glutamic acid diacetate (GLDA) and salts thereof, and (B) at least one alkoxylated alkyleneimine polymer with an average molecular weight $M_w$ in the range from 800 to 25 000 g/mol which has a positive charge density of at least 5 meq/g and which has in the range from 2 to at most 80% by weight, alkylene oxide side chains, based on total alkoxylated alkyleneimine polymer, and optionally (C) sodium citrate or (D) at least one compound selected from alkali metal percarbonate, alkali metal perborate and alkali metal persulfate, and optionally further components (E) are mixed together in one or more steps in the presence of water and then the water is completely or partially removed.

Compound (A), modified polyalkyleneimine (B) and bleach (D) are defined above.

In one embodiment of the present invention, before the water is at least partially removed, mixing with one or more further ingredients (E) for the formulation according to the invention is possible, for example with one or more surfactants, one or more enzymes, one or more builders, one or more cobuilders, in particular phosphorus-free builders, one or more alkali carriers, one or more bleaches, one or more bleach catalysts, one or more bleach activators, one or more bleach stabilizers, one or more antifoams, one or more corrosion inhibitors, one or more builder substances, with buffer or dye.

In one embodiment, the procedure involves removing the water from the formulation according to the invention entirely or partially, for example to a residual moisture in the range from 0.1 to 10% by weight, by evaporating it, in particular by means of spray-drying, spray granulation or compaction.

In one embodiment of the present invention, the water is removed, completely or partially, at a pressure in the range from 0.3 to 2 bar.

In one embodiment of the present invention, the water is removed, completely or partially, at temperatures in the range from 60 to 220° C.

By means of the production process according to the invention, formulations according to the invention can be obtained easily.

The cleaning formulations according to the invention can be provided in liquid or solid form, in a single-phase or multiphase, as tablets or in the form of other dosage units, in packaged or unpackaged form. The water content of liquid formulations can vary from 35 to 90% water. The invention is illustrated by working examples.

General: It was ensured that after the first cleaning of the test bodies in the domestic dishwasher until after the weighing and visual inspection of the glasses, the test bodies were handled only with clean cotton gloves so that the weight and/or the visual impression of the test bodies was not falsified.

Data in % are % by weight, unless expressly stated otherwise.

I. Preparation of Formulations According to the Invention

The charge density of modified polyethyleneimines (B) was always determined as follows (see also: Horn, Prog. Colloid & Polym. Sci. 1978, 65, 251):

1 g of the modified polyethyleneimine (B) in question was dissolved in 100 ml of demineralized water. A buffer solution and aqueous HCl were used to establish a pH of 4.0, determined potentiometrically. Three ml of an aqueous solution of toluidine blue (50 mg/l of water) were added, and N/400-KPVS (potassium polyvinyl sulfate) solution (Wako) with a concentration of 0.0004 meq/ml was titrated until the color changed from blue to pink. The charge density was calculated as follows:

$$LA=0.4\cdot KV$$

LA: Charge density of the modified polyethyleneimine (B) in question, meq/g (milliequivalent/g)

KV: Consumption of the N/400-KPVS solution [ml]

I.1 Preparation of Base Mixtures

Firstly, base mixtures were prepared from the feed materials according to table 1. The feed materials were mixed dry.

TABLE 1

Base mixtures for experiments with formulations according to the invention and comparison formulations

| | Base-1 | Base-2 | Base-3 |
|---|---|---|---|
| Protease | 2.5 | 2.5 | 2.5 |
| Amylase | 1 | 1 | 1 |
| n-$C_{18}H_{37}(OCH_2CH_2)_9OH$ | 5 | 5 | 5 |
| Polyacrylic acid $M_w$ 4000 g/mol, as sodium salt, completely neutralized | 10 | 10 | 10 |
| Sodium percarbonate (D.1) | 10.5 | 10.5 | 10.5 |
| TAED | 4 | 4 | 4 |
| $Na_2Si_2O_5$ | 2 | 2 | 2 |
| $Na_2CO_3$ | 19.5 | 19.5 | 19.5 |
| Sodium citrate dihydrate | 5 | 22.5 | 30 |

All data in g.

Abbreviations:

MGDA: Methylglycinediacetic acid as trisodium salt

TAED: N,N,N',N'-Tetraacetylethylenediamine

I.2 Preparation of Formulations According to the Invention

I.2.1 Preparation of Formulations 2 to 8 According to the Invention and of Comparison of Formulations V1

Modified polyethyleneimines (B) according to table 2 were used which had been prepared according to the following general procedure:

Polyethyleneimine according to table 2, column 2 and 3, and 0.7% by weight of KOH pellets (water content 50% by weight, remainder KOH), based on polyethyleneimine, were introduced into a 2 liter autoclave. The mixture was heated to 120° C. under reduced pressure (10 mbar) and stirred for 2 hours at 120° C., during which the water was removed. The autoclave was then flushed three times with nitrogen and then heated to 140° C. with a starting pressure of 1 bar. Then, over a period of 2 hours, either ethylene oxide or propylene oxide according to table 2, column 5 was added. When the addition was complete, the mixture was stirred for a further 3 hours at 140° C. Then, water or optionally other volatile compounds were removed under reduced pressure (10 mbar) at 90° C. This gave modified polyethyleneimines (B) according to table as pale yellow wax-like solids.

TABLE 2

Modified polyethyleneimines (B)

| Name | $M_w$ PEI (g/mol) | Amount of PEI (g) | Modification with | Amount of AO (g) | $M_w$ (B) (g/mol) | Moles of AO/ N—H | % by weight of AO | Cationic charge density (meq/g) |
|---|---|---|---|---|---|---|---|---|
| B1.1.1 | 600 | 415 | Ethylene oxide | 80 | 700 | 0.2 | 16 | 17 |
| B1.1.2 | 600 | 340 | Ethylene oxide | 150 | 800 | 0.45 | 31 | 14 |
| B1.1.3 | 600 | 40 | Ethylene oxide | 455 | 6200 | 12 | 92 | 2 |
| B1.2.1 | 1300 | 330 | Ethylene oxide | 165 | 1900 | 0.5 | 33 | 13.5 |
| B1.2.2 | 1300 | 270 | Ethylene oxide | 225 | 2500 | 0.8 | 45.5 | 11 |
| B1.2.3 | 1300 | 200 | Ethylene oxide | 290 | 3000 | 1.45 | 59 | 8 |
| B1.3.1 | 2000 | 240 | Ethylene oxide | 245 | 5600 | 1.0 | 50.5 | 10.5 |
| B1.4.1 | 25000 | 220 | Ethylene oxide | 260 | 48000 | 1.2 | 54 | 9.5 |
| B2.1.1 | 2000 | 370 | Propylene oxide | 130 | 2800 | 0.3 | 26 | 15 |
| B2.1.2 | 2000 | 270 | Propylene oxide | 220 | 3100 | 0.6 | 45 | 11 |
| B2.2.1 | 600 | 320 | Propylene oxide | 175 | 1000 | 0.4 | 35 | 13 |
| B2.2.2 | 600 | 210 | Propylene oxide | 285 | 1500 | 1.02 | 58 | 8.5 |
| B2.2.3 | 600 | 85 | Propylene oxide | 410 | 3500 | 4 | 83 | 3.5 |
| B2.1.3 | 5000 | 320 | Propylene oxide | 180 | 6200 | 0.42 | 37 | 12.5 |
| B2.4.1 | 10000 | 185 | Propylene oxide | 300 | 28000 | 1.2 | 62 | 7 |

Abbreviations in Table 2:

AO: alkylene oxide

Column 2: $M_w$ PEI refers to the molecular weight of the polyethyleneimine used for the alkoxylation, i.e. to non-modified polyethyleneimine.

Column 3: PEI refers to non-modified polyethyleneimine.

Column 7: the molar fractions refer to the starting substances.

Column 8: weight fraction of alkylene oxide in the total alkoxylated alkyleneimine polymer (B) in question.

Procedure:

20 ml of distilled water was placed in a 100 ml beaker and modified polyethyleneimine (B) according to tables 2 and 3 was added with stirring.

Stirring was then carried out for 10 minutes. MGDA trisodium salt (A.1), dissolved in 30 ml of water, was then added as per table 3. This gave a clearly transparent solution. Base mixture as per table 3 was then added, the mixture was stirred again, and the water was evaporated.

If, in the test, the corresponding fractions of base mixture are metered in separately from aqueous solution of (A.1), (B), (C.1) or (D.1), the same results are obtained as when the dried formulation was tested with identical amounts of active ingredient. The order of the metered addition is therefore of no consequence.

II. Use of Formulations According to the Invention and Comparison Formulations for the Machine Cleaning of Glasses General: It was ensured that after the first cleaning of the test bodies in the domestic dishwasher until after the weighing and visual inspection of the glasses, the test bodies were handled only with clean cotton gloves so that the weight and/or the visual impression of the test bodies was not falsified.

The testing of formulations according to the invention and comparison formulations was carried out as follows.

II.1 Test Method for Dishwasher with Continuous Operation

Dishwasher: Miele G 1222 SCL

Program: 65° C. (with prewash)

Ware: 3 "GILDS" champagne glasses, 3 "INTERMEZZO" brandy glasses

For the cleaning, the glasses were arranged in the upper crockery basket of the dishwasher. The dishwashing detergent used was in each case 25 g of formulation according to the invention or 25 g of comparison formulation according to table 3, table 3 specifying in each case individually the active components (A.1), base mixture, silicate (C.1 or C.2) and compound (D) and/or (E) and (B) of formulation according to the invention. Washing was carried out at a clear-rinse temperature of 55° C. The water hardness was in each case in the range from zero to 2° German hardness. Washing was carried out in each case for 100 wash cycles, i.e. the program was left to run 100×. The evaluation was made gravimetrically and visually after 100 wash cycles.

The weight of the glasses was determined before the start of the first wash cycle and after drying after the last wash cycle. The weight loss is the difference in the two values.

Besides the gravimetric evaluation, a visual assessment of the ware after 100 cycles in a darkened chamber with light behind a perforated plate was carried out using a grading scale from 1 (very poor) to 5 (very good). In this connection, grades were awarded in each case for patchy corrosion/clouding and/or line corrosion.

Experimental Procedure:

Firstly, for the purposes of pretreatment, the test bodies were washed in a domestic dishwasher (Bosch SGS5602) with 1 g of surfactant (n-$C_{18}H_{37}(OCH_2CH_2)_{10}OH$) and 20 g of citric acid in order to remove any soilings. The test bodies were dried, their weight was determined and they were fixed to the grid base insert.

To assess the gravimetric abrasion, the dry test bodies were weighed. The visual assessment of the test bodies was then made. For this, the surface of the test bodies was assessed with regard to line corrosion (score lines) and clouding corrosion (patchy clouding).

The assessments were carried out according to the following scheme.

Line Corrosion:

L5: no lines evident

L4: slight line formation in a very few areas, fine line corrosion

L3: line corrosion in some areas

L2: line corrosion in a number of areas

L1: pronounced line corrosion

Glass Clouding

L5: no clouding evident

L4: slight clouding in a very few areas

L3: clouding in some areas

L2: clouding in a number of areas

L1: pronounced clouding over virtually the entire glass surface

In the case of the inspection, interim grades (e.g. L3-4) were also allowed.

If, instead of water, hardness water with 2° German hardness was used for the tests, then formulations according to the invention were likewise always superior to the corresponding comparison formulations as far as inhibiting the glass corrosion is concerned.

II.3 Results

The results are summarized in Table 3.

TABLE 3

Results of the tests with dishwasher (continuous operation)

| Example No. | Base mixture: [g] | (A.1) [g] | (B) [mg] | Weight loss Champagne glass [mg] | Weight loss Brandy glass [mg] | Visual assessment Champagne glass | Visual assessment Brandy glass |
|---|---|---|---|---|---|---|---|
| V-1 | Base-2: 17 | 3 | — | 80 | 48 | L1, T1-2 | L1, T1-2 |
| 1 | Base-2: 17 | 3 | 60 (B.1.1.1) | 17 | 9 | L4, T4-5 | L4, T5 |
| 2 | Base-2: 17 | 3 | 30 (B.1.1.1) | 19 | 11 | L3-4, T4-5 | L4, T5 |
| 3 | Base-2: 17 | 3 | 30 (B.1.1.2) | 22 | 13 | L3-4, T4-5 | L3-4, T4-5 |
| 4 | Base-2: 17 | 3 | 30 (B.1.4.1) | 37 | 23 | L3, T3-4 | L3, T4 |
| V-5 | Base-2: 17 | 3 | 30 (B.1.1.3) | 67 | 36 | L2, T2 | L1-2, T2-3 |
| 6 | Base-2: 17 | 3 | 25 (B.2.2.1) | 25 | 16 | L3-4, T4-5 | L3, T4-5 |
| 7 | Base-2: 17 | 3 | 25 (B.2.2.2) | 40 | 27 | L3, T3-4 | L3, T3-4 |
| V-8 | Base-2: 17 | 3 | 25 (B.2.2.3) | 69 | 39 | L2-3, T2 | L2, T2 |

Only slight or even no glass corrosion was always established in the examples according to the invention

The invention claimed is:

1. A formulation comprising:

(A) at least one aminocarboxylate selected from the group consisting of methylglycine diacetate (MGDA), iminodisuccinic acid (IDA) and glutamic acid diacetate (GLDA), and salts thereof;

(B) an alkoxylated alkyleneimine polymer with an average molecular weight $M_w$ in the range from 800 to 25 000 g/mol which has a positive charge density of at least 5 meq/g and which has in the range from 2 to at most 80% by weight alkylene oxide side chains, based on total alkoxylated alkyleneimine polymer, wherein the formulation is free from heavy metals.

2. The formulation according to claim 1, which is free from phosphates and polyphosphates.

3. The formulation according to claim 1, wherein (B) is a polyethyleneimine that has been reacted with ethylene oxide or propylene oxide.

4. The formulation according to claim 1, which has a heavy metal content below 0.05 ppm, based on a solid content of the formulation.

5. The formulation according to claim 1, wherein at most 30 mol % of the nitrogen atoms of the alkyleneimine polymer have been reacted with propylene oxide.

6. The formulation according to claim 1, which is solid at room temperature.

7. The formulation according to claim 1, which further comprises in the range from 0.1 to 10% by weight of water.

8. The formulation according to claim 1, wherein a molar ratio of nitrogen atoms to alkylene oxide groups in the alkoxylated alkyleneimine polymer is at most 5.

9. The formulation according to claim 1, which comprises:

in total in the range from 1 to 50% by weight of the aminocarboxylate, in total in the range from 0.001 to 2% by weight of the alkoxylated alkyleneimine polymer, based in each case on a solid content of the formulation.

10. A process of washing dishes or kitchen utensils, comprising contacting the formulation of claim 1 with the dishes or utensils, where washing is carried out with water of hardness from 2 to 25° German hardness.

11. A process of washing an object having at least one surface made of glass, which may be decorated or undecorated, the process comprising contacting the formulation of claim 1 with the object.

12. The process according to claim 10, wherein the washing is washing using a dishwasher.

13. The process according to claim 10, wherein the dishes or kitchen utensils are drinking glasses, glass vases or glass vessels for cooking.

14. A process for producing the formulation of claim 1, the process comprising mixing the aminocarboxylate with the alkoxylated alkyleneimine and optionally a further component in one or more steps in the presence of water, and then completely or partially removing the water.

15. The process according to claim 14, wherein the water is removed by spray-drying or spray-granulation.

16. The formulation according to claim 2, wherein (B) is a polyethyleneimine that has been reacted with ethylene oxide or propylene oxide.

17. The formulation according to claim 2, which has a heavy metal content below 0.05 ppm, based on a solid content of the formulation.

18. The formulation according to claim 3, which has a heavy metal content below 0.05 ppm, based on a solid content of the formulation.

19. The formulation according to claim 1, comprising methylglycine diacetate.

20. The formulation according to claim 1, comprising iminodisuccinic acid.

* * * * *